US009680248B1

(12) United States Patent
Chen

(10) Patent No.: US 9,680,248 B1
(45) Date of Patent: Jun. 13, 2017

(54) HYBRID PLUG CONNECTOR

(71) Applicant: OUPIIN ELECTRONIC (KUNSHAN) CO., LTD, Kunshan, Jiangsu (CN)

(72) Inventor: Hsin Chih Chen, Jiangsu (CN)

(73) Assignee: OUPIIN ELECTRONIC (KUNSHAN) CO., LTD, Jiangsu (CN)

( * ) Notice: Subject to any disclaimer, the term of this patent is extended or adjusted under 35 U.S.C. 154(b) by 0 days.

(21) Appl. No.: 15/265,858

(22) Filed: Sep. 15, 2016

(30) Foreign Application Priority Data

Apr. 18, 2016 (CN) ..... 2016 1 0238861

(51) Int. Cl.
*H01R 13/514* (2006.01)
*H01R 13/436* (2006.01)

(52) U.S. Cl.
CPC ..... *H01R 13/436* (2013.01)

(58) Field of Classification Search
CPC .. H01R 13/436; H01R 12/727; H01R 13/514; H01R 12/58; H01R 12/7088; H01R 13/11; H01R 13/432
USPC ..... 439/752
See application file for complete search history.

(56) References Cited

U.S. PATENT DOCUMENTS 6,319,075 B1 * 11/2001 Clark ..... H01R 13/11 439/65
8,662,913 B2 * 3/2014 Tai ..... H01R 13/432 439/345
9,401,558 B1 * 7/2016 Yu ..... H01R 4/02
2004/0115997 A1 * 6/2004 Scherer ..... H01R 13/514 439/752
2006/0223382 A1 * 10/2006 Ho ..... H01R 12/727 439/752
2009/0197466 A1 * 8/2009 Cheng ..... H01R 12/7088 439/589
2010/0041266 A1 * 2/2010 Data ..... H01R 12/7088 439/358
2012/0164892 A1 * 6/2012 Ke ..... H01R 27/02 439/676
2012/0289071 A1 * 11/2012 Dodds ..... H01R 12/724 439/183
2014/0127949 A1 * 5/2014 Yu ..... H01R 12/58 439/660
2014/0141656 A1 * 5/2014 Chen ..... H01R 12/7088 439/682

* cited by examiner

*Primary Examiner* — Jean F Duverne
(74) *Attorney, Agent, or Firm* — Soroker Agmon Nordman

(57) ABSTRACT

A hybrid plug connector is disclosed in this invention. The hybrid plug connector includes a plug housing, a row of signal terminal assemblies and a row of power terminals. Each power terminal includes two independent and symmetrical conductive plates, which are combined together. Each conductive plate has a first protrusion and a second protrusion located below the first protrusion. When the power terminal is mounted on the plug housing, the first and second protrusions can clamp a beam located in a corresponding power terminal-receiving passage to prevent the power terminal from falling off when being shook up and down.

10 Claims, 11 Drawing Sheets

HYBRID PLUG CONNECTOR

BACKGROUND OF THE INVENTION

1. Field of the Invention

The present invention relates to a connector technology, and more particularly to a hybrid plug connector with power supply and signal transmission functions.

2. Description of the Prior Art

In the present market, it has a demand for a high current connector, and it hopes that the high current connector can make power and signal be integrated together to provide a current of 260 amp per inch linear space, and an integrity of power and signal is also indispensable.

Hence, it is needed to provide a hybrid plug connector with power supply and signal transmission functions for satisfying the market demand for large current and small space of the electrical connector.

BRIEF SUMMARY OF THE INVENTION

An object of the present invention is to provide a hybrid plug connector, in which power supply and signal transmission functions are integrated together and can ensure integrity of the power supply and the signal transmission, wherein the hybrid plug connector has a strong structural stability and safety and can be connected with an external receptacle connector safely and accurately.

Other objects and advantages of the present invention may be further understood from the technical features disclosed by the present invention.

To achieve the aforementioned object or other objects of the present invention, the present invention adopts the following technical solution.

The present invention provides a hybrid plug connector, which comprises a plug housing, a row of signal terminal assemblies and a row of power terminals. The plug housing includes a signal plug part and a power plug part adjacent to the signal plug part. The signal plug part has a signal port formed on the front thereof, and a row of signal terminal-receiving passages formed on the rear thereof and communicated with the signal port. The power plug part has a row of power terminal-receiving passages passing through the front and rear thereof. Each power terminal-receiving passage has a pair of crossbeams formed on a left wall and a right wall of the power terminal-receiving passage and separated each other. Each of the signal terminal assemblies includes an insulative frame, multiple signal contact arms extending out of the front of the insulative frame, and multiple signal tails extending out of the bottom of the insulative frame. The insulative frame is mounted in the corresponding signal terminal-receiving passage. The signal contact arms enter into the signal port. The signal tails extend out of the bottom of the signal plug part. Each of the power terminals includes two independent and symmetrical conductive plates. The two conductive plates are combined together. Each conductive plate has a vertical plate, a mating portion located in front of the vertical plate, a tilted connection portion formed by being bent outward from a bottom edge of the vertical plate, and multiple power tails located under the connection portion. The conductive plate further has a first protrusion and a second protrusion located below the first protrusion. When the power terminal is mounted in the power plug part, the mating portions of the two conductive plate extend out of the front of the power plug part, the vertical plates thereof are clamped by the pair of crossbeams, the first protrusion and the second protrusion together clamp the corresponding crossbeam along a vertical direction, and the tails thereof extend out of the bottom of the power plug part.

In one embodiment, a vertical distance between the first protrusion and the second protrusion is equal to a height of the crossbeam; the first protrusion is formed on one side of the vertical plate; the second protrusion is formed on the connection portion; and the pair of crossbeams are symmetrical to each other and extend along a front and rear direction.

In one embodiment, the first protrusion is a closed circular are profile; the second protrusion is upright and has a free end; the crossbeam is clamped by the bottom of the first protrusion and the free end of the second protrusion; and the conductive plate has two second protrusions on the connection portion.

In one embodiment, the mating portion of the conductive plate is blade-like and located on a same vertical plane with the vertical plate.

In one embodiment, the power plug part further has a long slot, which is formed on the top of the power plug part and is communicated with the power terminal-receiving passages, and an anti-mistake recess formed on one sidewall of the long slot; and the vertical plate has an opening formed on a top edge thereof and a hook located on a sidewall of the opening;

when the power terminal is mounted in the power plug part, the opening is aligned with the long slot.

In one embodiment, the hybrid plug connector further comprises at least one tie bar, which includes an anti-mistake bump located on the front of the tie bar and multiple locks located on the rear of the tie bar, the tie bar is embedded into the long slot of the power plug part and enters into the openings of the power terminals; wherein the anti-mistake bump is engaged with the anti-mistake recess, and these locks are engaged with the hooks of the power terminals.

In one embodiment, the hybrid plug connector further comprises two guiding posts, which are symmetrically disposed on the top of the plug housing, and each of which has a column body with a cross-shaped section and a tip end.

In one embodiment, the signal plug part further includes a row of retaining holes formed on the top thereof and communicated with the corresponding signal terminal-receiving passages; the insulative frame has a cut formed on the top thereof and a cantilever beam located in the cut and extending backward from a front wall of the cut; the cantilever beam forms a protrusion protruding upward on the end thereof; the cut of the insulative frame is aligned with the corresponding retaining hole of the signal plug part, and the cantilever beam and the protrusion enter into the corresponding retaining hole.

In one embodiment, the plug housing has two power plug parts located two sides of the signal plug part respectively; a front surface of the signal plug part is located in front of a front surface of each power plug part; and the row of signal terminal assemblies is located in the middle of the row of power terminals.

In one embodiment, the plug housing is further provided with multiple narrow holes on the top thereof and these narrow holes are communicated with some power terminal-receiving passages for dissipating the heat.

In comparison with the prior art, the hybrid plug connector of the present invention can make power supply and signal transmission functions be integrated together for ensuring integrity of the power supply and the signal transmission. The hybrid plug connector of the present invention further improves a strong structural stability and safety thereof by modifying the power terminals. Moreover, the hybrid plug connector of the present invention further can be connected with an external receptacle connector safely and accurately by modifying the guiding posts.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
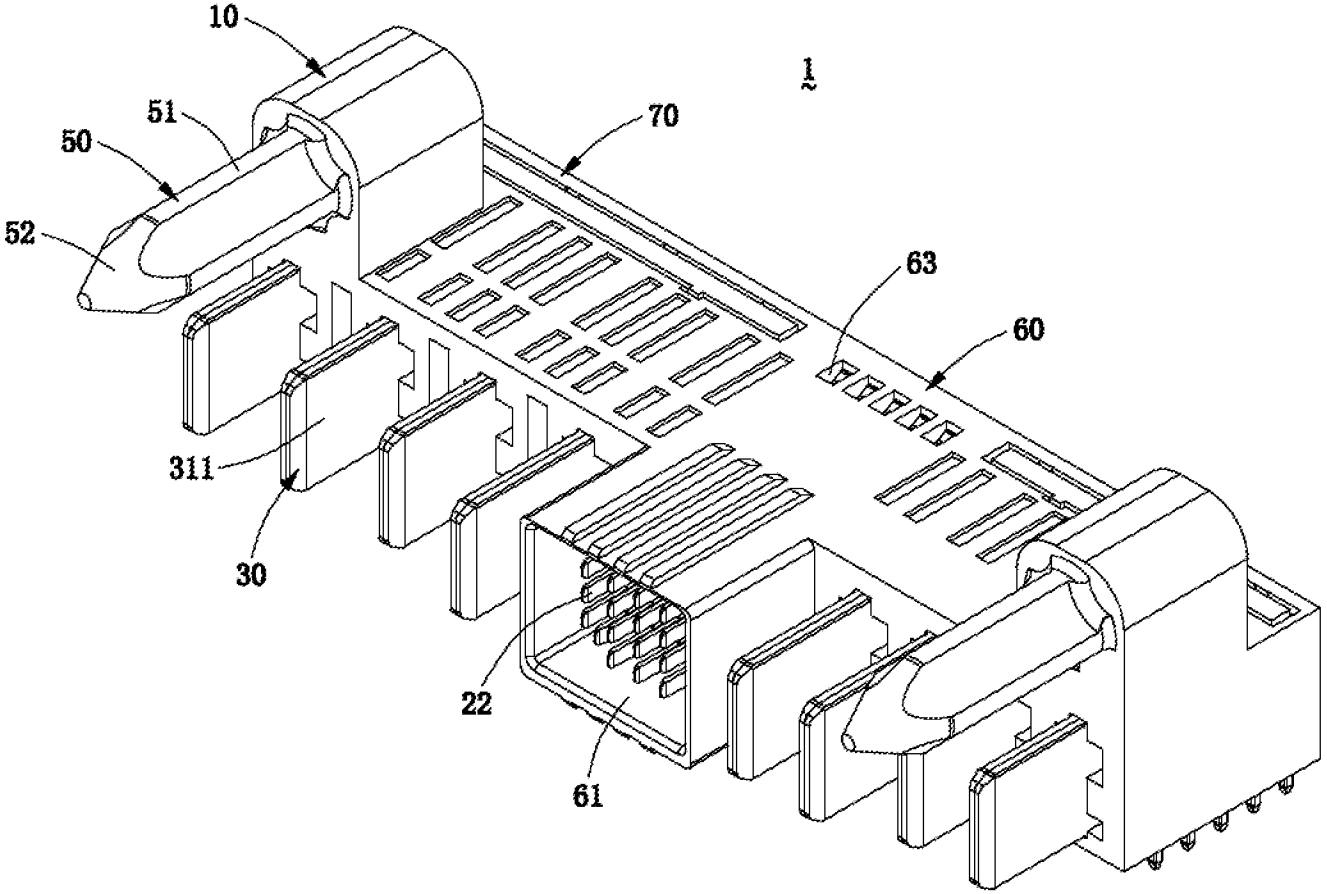
FIG. 1 is a perspective schematic view of a hybrid plug connector of the present invention.
Figure 2:
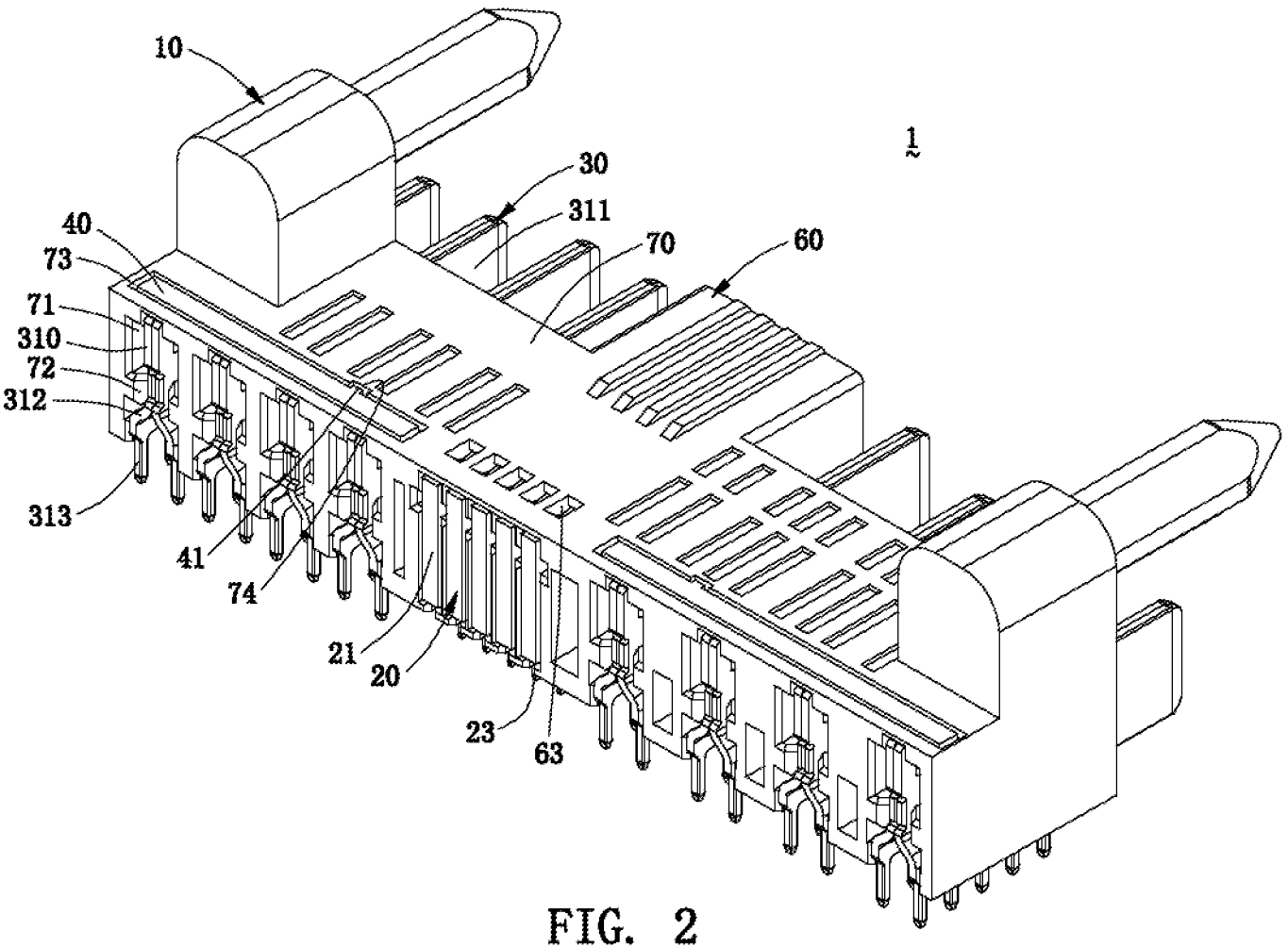
FIG. 2 is a perspective schematic view of the hybrid plug connector along another direction.

Please refer to FIGS. 1 and 2, a hybrid plug connector 1 of the present invention is a horizontal plug connector, the mating direction of which is parallel to a circuit board (not shown).

Figure 3:
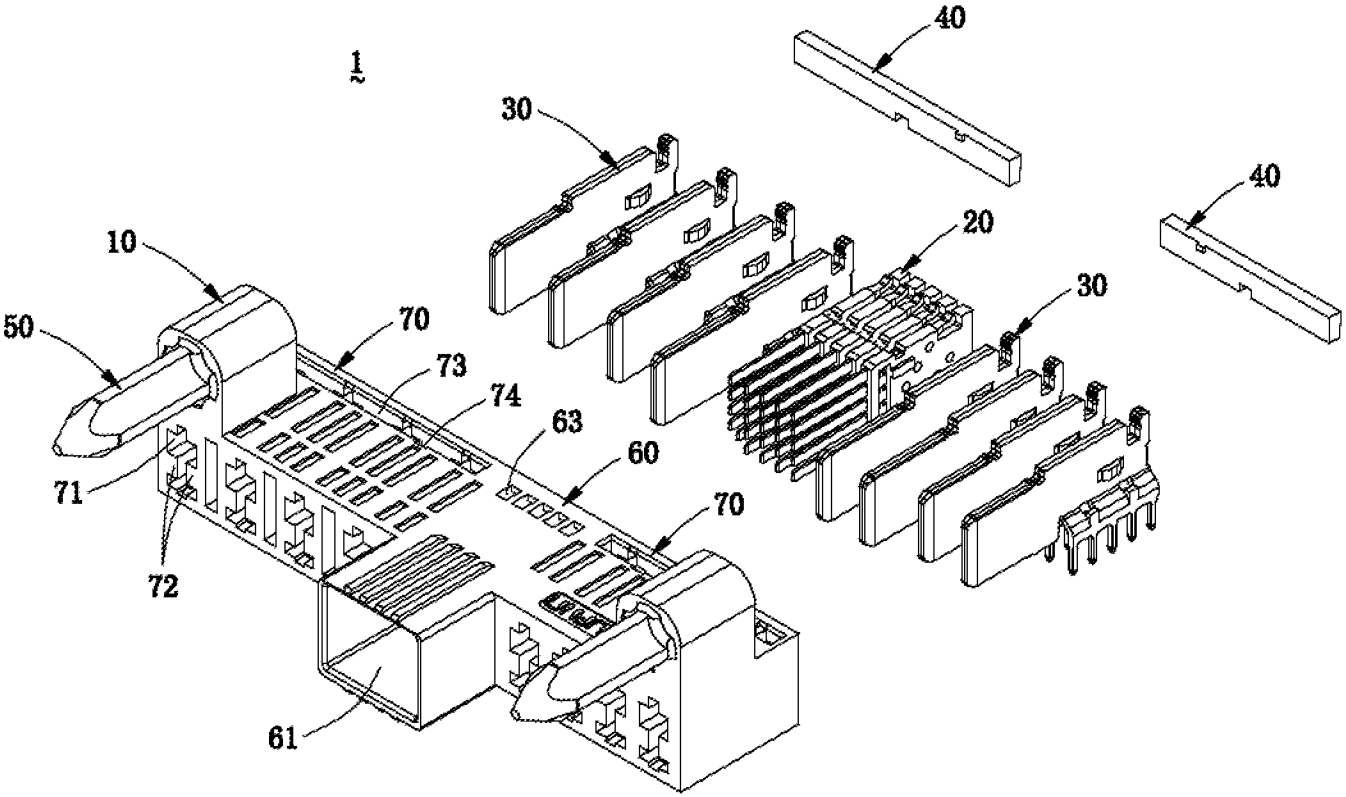
FIG. 3 is an exploded view of the hybrid plug connector shown in FIG. 1.
Figure 4:
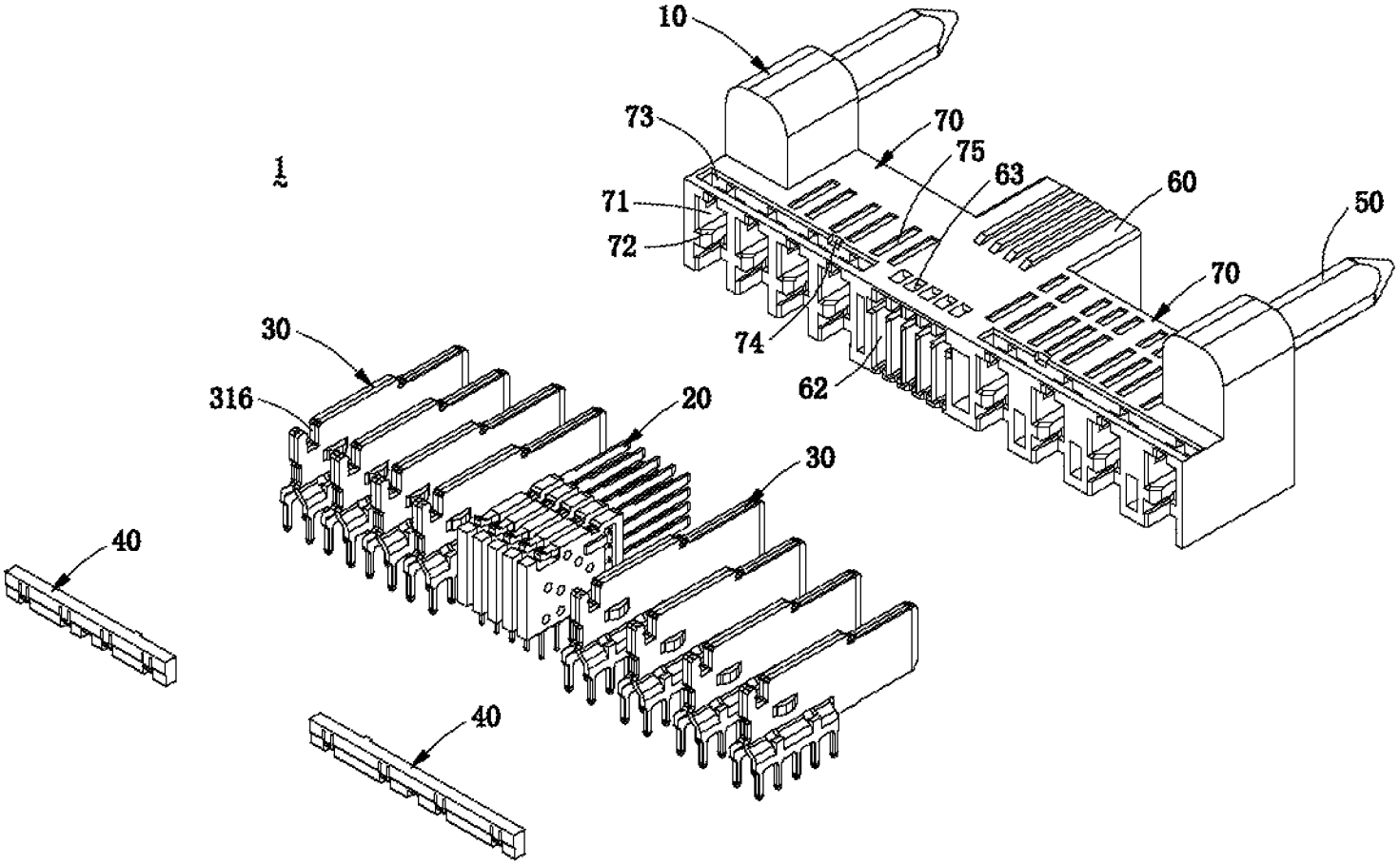
FIG. 4 is an exploded view of the hybrid plug connector shown in FIG. 2.
Figure 5:
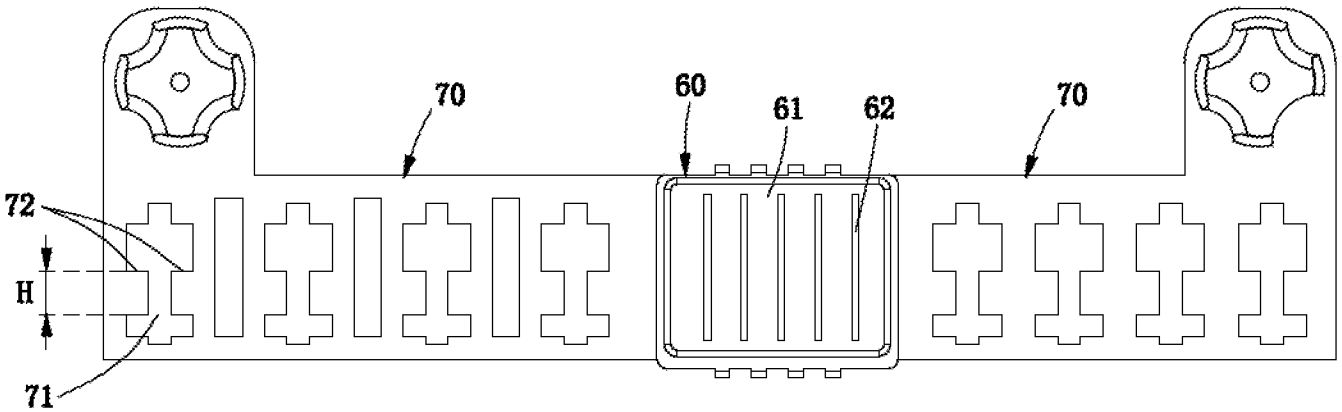
FIG. 5 is a front view of a plug housing of the present invention.
Figure 6:
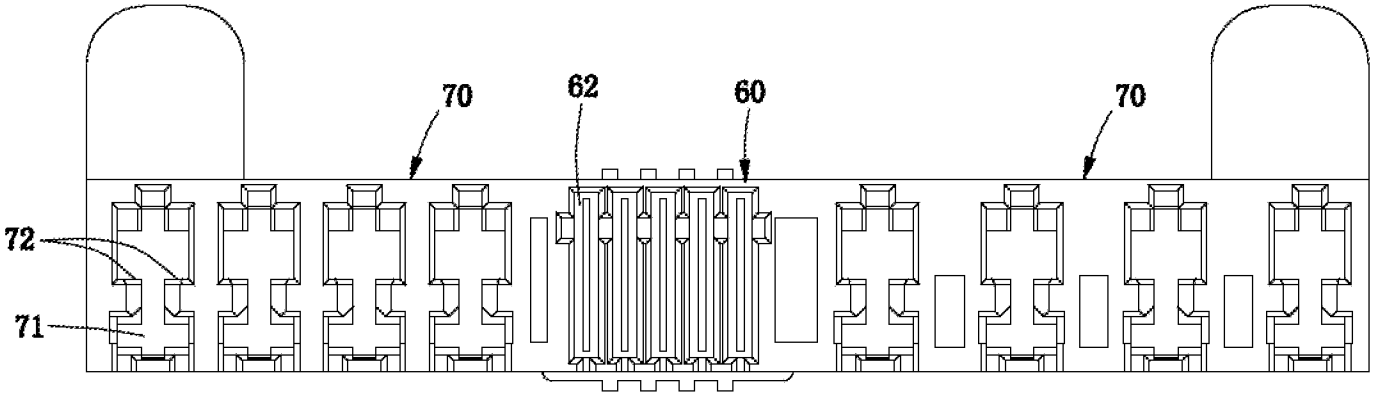
FIG. 6 is a rear view of a plug housing of the present invention.

Please refer to FIGS. 3 and 4, the hybrid plug connector 1 of the present invention includes a plug housing 10, a row of signal terminal assemblies 20 mounted in the plug housing 10, a row of power terminals 30 mounted in the plug housing 10, at least one tie bar 40 used to fix these power terminals 30, and two guiding posts 50 symmetrically disposed on the top of the plug housing 10. In the embodiment, this row of signal terminal assemblies 20 is located in the middle of the row of power terminals 30. In the embodiment, the hybrid plug connector 1 of the present invention includes two tie bars 40 for fixing the row of power terminals 30, which are separated.

As shown in FIGS. 3 and 4, the plug housing 10 includes a signal plug part 60 and a power plug part 70 adjacent to the signal plug part 60. In the embodiment, the plug housing 10 has two power plug parts 70 located on two sides of the signal plug part 60 respectively. A front surface of the signal plug part 60 is located in front of a front surface of each power plug part 70.

As shown in FIGS. 3 to 6, the signal plug part 60 has a signal port 61 formed on the front thereof, and a row of signal terminal-receiving passages 62 formed on the rear thereof and communicated with the signal port 61. In the embodiment, the signal port 61 is generally rectangular. The signal plug part 60 further has a row of retaining holes 63 on the top thereof which are communicated with the corresponding signal terminal-receiving passages 62.

As shown in FIGS. 3 to 6, the power plug part 70 has a row of power terminal-receiving passages 71 passing through the front and rear of the power plug part 70. Each power terminal-receiving passage 71 has a pair of crossbeams 72 formed therein and separated each other. Specifically, the pair of crossbeams 72 are symmetrically formed on a left wall and a right wall of the power terminal-receiving passage 71 and extends along a front and rear direction. There forms a space (not labeled) between the pair of crossbeams 72 that the corresponding power terminal 30 can go through. As shown in FIG. 4, the power plug part 70 further has a long slot 73, which is formed on the top of the power plug part 70 and is communicated with these power terminal-receiving passages 71. The long slot 73 forms an anti-mistake recess 74 on one sidewall thereof.

Moreover, these signal terminal-receiving passages 62 and these power terminal-receiving passages 71 have open bottoms, so all terminal tails can go through the bottoms and then be mounted on an outside circuit board. The plug housing 10 further has multiple narrow holes 75 (label seen in FIG. 4) on the top thereof. These narrow holes 75 are communicated with some power terminal-receiving passages 71 for dissipating the heat.

Figure 7:
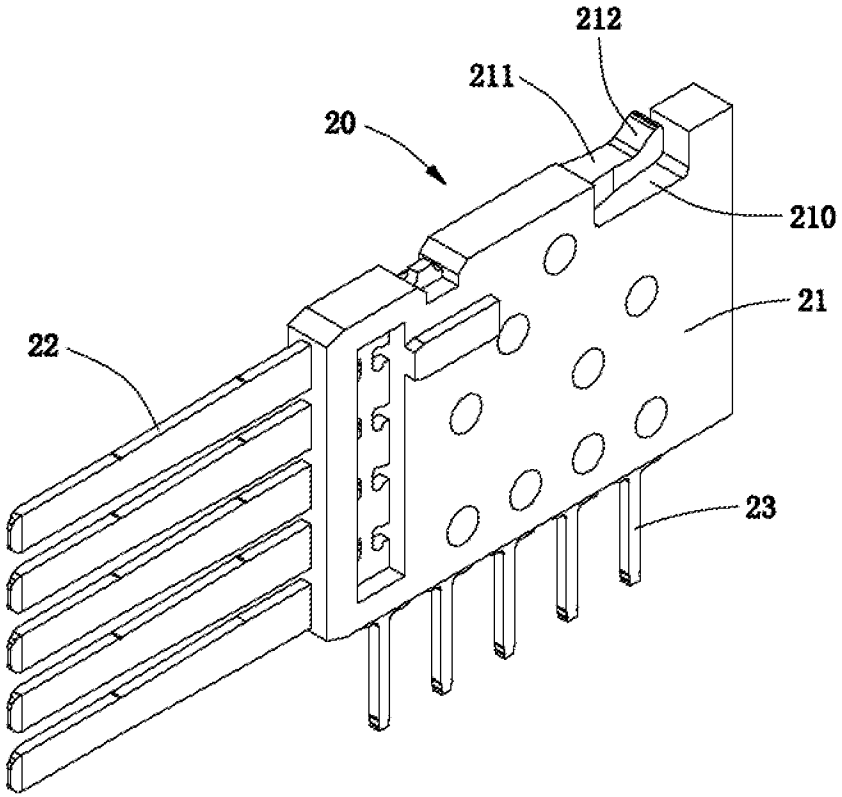
FIG. 7 is a perspective schematic view of one signal terminal assembly of the present invention.

As shown in FIG. 7, each signal terminal assembly 20 includes an insulative frame 21, multiple signal contact arms 22 extending out of the front of the insulative frame 21 and arranged in a straight line along an upper and lower direction, and multiple signal tails 23 extending out of the bottom of the insulative frame 21 and arranged in a straight line along the front and rear direction. The insulative frame 21 has a cut 210 formed on the top thereof and a cantilever beam 211 located in the cut 210 and extending backward from a front wall of the cut 210. The cantilever beam 211 forms a protrusion 212 protruding upward on the end thereof. In the embodiment, the signal tails 23 are pin-typed.

Please refer to FIGS. 1, 2 and 7, when the signal terminal assembly 20 is mounted in the signal plug part 60, the insulative frame 21 is fixed on the corresponding signal terminal-receiving passage 62 (label seen in FIG. 4), these signal contact arms 22 enter into the signal port 61, and these signal tails 23 extend out of the bottom of the signal plug part 60 to be ready for the connection to the outside circuit board. The cut 210 of the insulative frame 21 is aligned with the corresponding retaining hole 63 of the signal plug part 60, and the cantilever beam 211 and the protrusion 212 can enter into the corresponding retaining hole 63. The protrusion 212 can prevent the insulative frame 21 from retreating from the plug housing 10.

Figure 8:
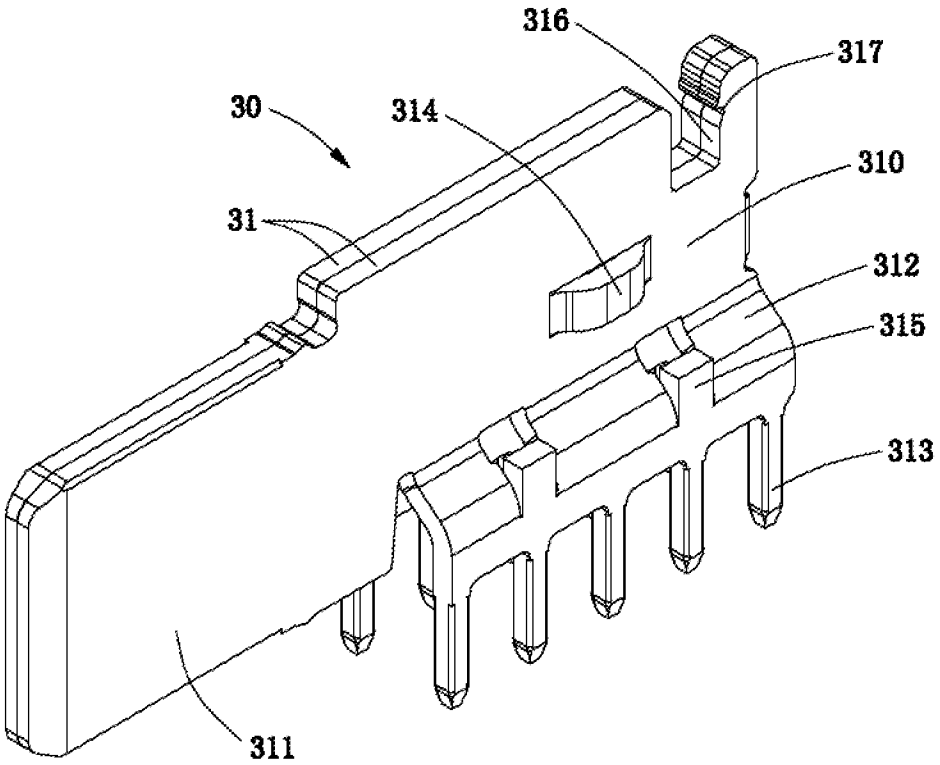
FIG. 8 is a perspective schematic view of a power terminal of the present invention.

Please refer to FIG. 8, each power terminal 30 includes two independent and symmetrical conductive plates 31, which are combined together. Each conductive plate 31 has a vertical plate 310, a blade-like mating portion 311 located in front of the vertical plate 310 and located on a same vertical plane with the vertical plate 310, a tilted connection portion 312 formed by being bent outward from a bottom edge of the vertical plate 310, and multiple power tails 313 located under the connection portion 312.

Please again refer to FIG. 8, the vertical plates 310 of the two conductive plates 31 close together, the mating portions 311 thereof also close together, and the connection portions 312 thereof are bent toward in two opposite directions. Each conductive plate 31 further has a first protrusion 314 and a second protrusion 315 located below the first protrusion 314.

Figure 8A:
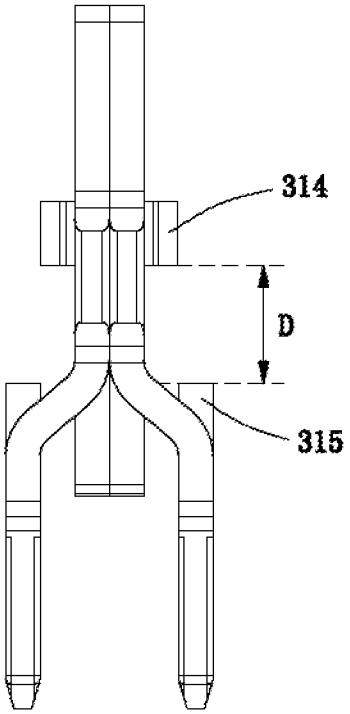
FIG. 8*a* is a front plan view of a power terminal of the present invention.

Please refer to FIG. 8*a*, a vertical distance D between the first protrusion 314 and the second protrusion 315 is generally equal to a height H (shown in FIG. 5) of the crossbeam 72.

Please refer to FIG. 8, in the embodiment, the first protrusion 314 is formed on one side of the vertical plate 310 and it is a closed circular arc profile formed by stamping. The second protrusion 315 is formed on the connection portion 312 by stamping, and it is upright and has a free end. In the embodiment, the conductive plate 31 has two second protrusions 315 on the connection portion 312. Moreover, the vertical plate 310 has an opening 316 formed on a top edge thereof and a hook 317 located on a sidewall of the opening 316. In the embodiment, these power tails 313 are pin-typed.

Figure 9:
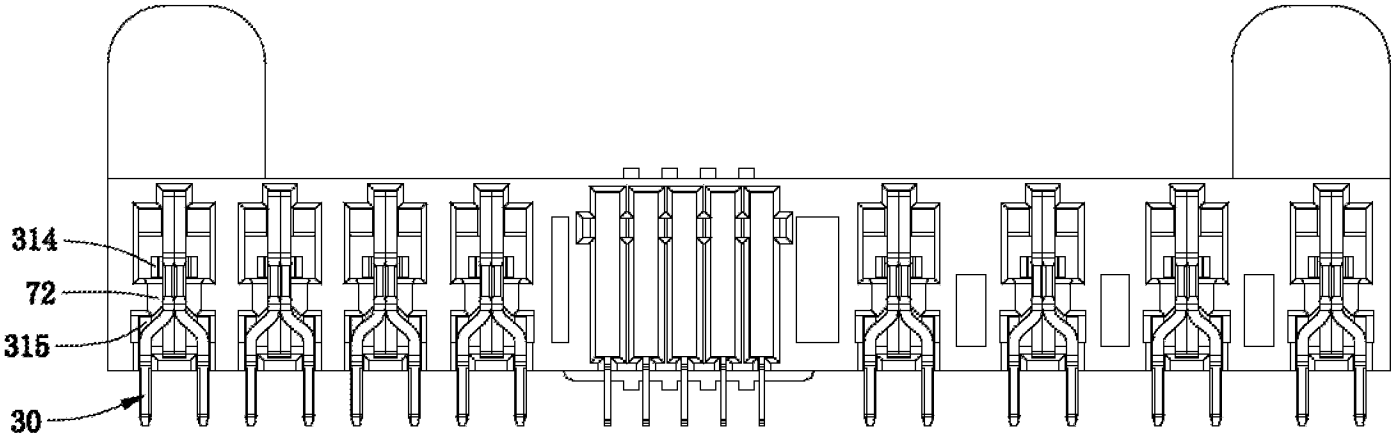
FIG. 9 is a rear view of the hybrid plug connector, which mainly shows a relationship between the power terminal and the plug housing.

Please refer to FIGS. 1 and 2, when the power terminal 30 is mounted in the power plug part 70, the mating portions 311 extend from the front of the power plug part 70, the vertical plates 310 and the connection portions 312 are fixed in the corresponding power terminal-receiving passage 71, the vertical plates 310 are further clamped by the pair of crossbeams 72, and these tails 313 extend out of the bottom of the power plug part 70 to be ready for the connection to the outside circuit board. As shown in FIG. 9, the first protrusion 314 is located on the top of the crossbeam 72 and supported by the crossbeam 72. The second protrusion 315 is located under the crossbeam 72, and the top of the second protrusion 315 contacts with the bottom of the crossbeam 72. In other words, the first protrusion 314 and the second protrusion 315 together clamp the corresponding crossbeam 72 along a vertical direction, so that preventing the power terminal 30 from falling off when being shook up and down. Actually, the crossbeam 72 is clamped by the bottom of the first protrusion 314 and the free end of the second protrusion 315.

Furthermore, as shown in FIG. 4, when the power terminal 30 is mounted in the power plug part 70, the opening 316 is aligned with the long slot 73 for together receiving the tie bar 40.

Figure 10:
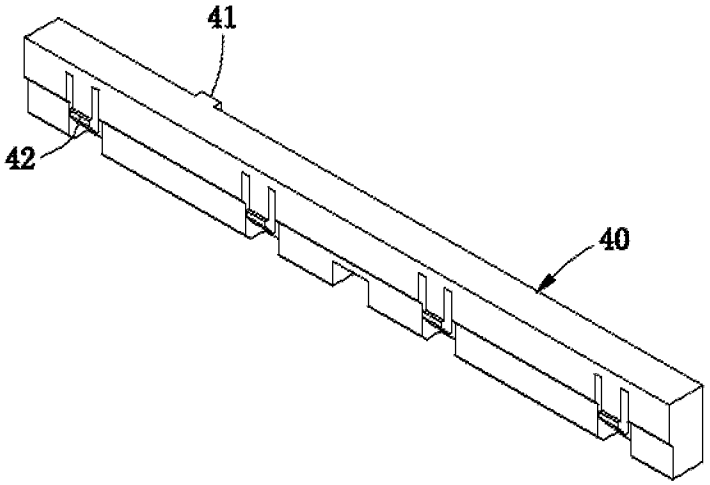
FIG. 10 is a perspective schematic view of a tie bar.

Please refer to FIG. 10, the tie bar 40 is used to fix these power terminals 30. The tie bar 40 is provided with an anti-mistake bump 41 located on the front of the tie bar 40 and multiple locks 42 located on the rear thereof.

Please refer to FIGS. 2, 8 and 10, when these power terminals 30 are mounted in the power plug part 70, the tie bar 40 is embedded into the long slot 73 and enters into the openings 316 of these power terminals 30. Now, the anti-mistake bump 41 is engaged with the anti-mistake recess 74, these locks 42 are engaged with the hooks 317 of these power terminals 30, whereby the tie bar 40 is fixed in the long slot 73 and the power terminals 30 are further fixed in the power plug part 70.

As shown in FIG. 1, the two guiding posts 50 are symmetrically disposed on the top of the two power plug parts 70. Each guiding post 50 has a column body 51 with a cross-shaped section and a tip end 52. The tip end 52 extends forward beyond the front of the signal plug part 60 for being beneficial to provide guidance for docking, and the column body 51 with the cross-shaped section is beneficial to improve the structural strength of the guiding posts 50.

As described above, the hybrid plug connector 1 of the present invention can make power supply and signal transmission functions be integrated together for ensuring integrity of the power supply and the signal transmission. The hybrid plug connector 1 of the present invention further improves a strong structural stability and safety thereof by modifying the power terminals 30. Moreover, the hybrid plug connector 1 of the present invention further can be connected with an external receptacle connector safely and accurately by modifying the guiding posts 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hybrid plug connector comprising:

a plug housing including a signal plug part and a power plug part adjacent to the signal plug part; the signal plug part having a signal port formed on the front thereof, and a row of signal terminal-receiving passages formed on the rear thereof and communicated with the signal port; the power plug part having a row of power terminal-receiving passages passing through the front and rear thereof; each power terminal-receiving passage having a pair of crossbeams formed on a left wall and a right wall of the power terminal-receiving passage and separated each other;

a row of signal terminal assemblies, each of which includes an insulative frame, multiple signal contact arms extending out of the front of the insulative frame, and multiple signal tails extending out of the bottom of the insulative frame; the insulative frame being mounted in the corresponding signal terminal-receiving passage; the signal contact arms entering into the signal port; and the signal tails extending out of the bottom of the signal plug part; and a row of power terminals, each of which includes two independent and symmetrical conductive plates; the two conductive plates being combined together, each conductive plate having a vertical plate, a mating portion located in front of the vertical plate, a tilted connection portion formed by being bent outward from a bottom edge of the vertical plate, and multiple power tails located under the connection portion; the conductive plate further having a first protrusion and a second protrusion located below the first protrusion; when the power terminal is mounted in the power plug part, the mating portions of the two conductive plate extending out of the front of the power plug part, the vertical plates thereof being clamped by the pair of crossbeams, the first protrusion and the second protrusion together clamping the corresponding crossbeam along a vertical direction, and the tails thereof extending out of the bottom of the power plug part.

2. The hybrid plug connector as claimed in claim 1, wherein a vertical distance between the first protrusion and the second protrusion is equal to a height of the crossbeam; the first protrusion is formed on one side of the vertical plate; the second protrusion is formed on the connection portion; and the pair of crossbeams are symmetrical to each other and extend along a front and rear direction.

3. The hybrid plug connector as claimed in claim 2, wherein the first protrusion is a closed circular are profile; the second protrusion is upright and has a free end; the crossbeam is clamped by the bottom of the first protrusion and the free end of the second protrusion; and the conductive plate has two second protrusions on the connection portion.

4. The hybrid plug connector as claimed in claim 1, wherein the mating portion of the conductive plate is blade-like and located on a same vertical plane with the vertical plate.

5. The hybrid plug connector as claimed in claim 1, wherein the power plug part further has a long slot, which is formed on the top of the power plug part and is communicated with the power terminal-receiving passages, and an anti-mistake recess formed on one sidewall of the long slot; and the vertical plate has an opening formed on a top edge thereof and a hook located on a sidewall of the opening;

when the power terminal is mounted in the power plug part, the opening is aligned with the long slot.

6. The hybrid plug connector as claimed in claim 5, wherein the hybrid plug connector further comprises at least one tie bar, which includes an anti-mistake bump located on the front of the tie bar and multiple locks located on the rear of the tie bar, the tie bar is embedded into the long slot of the power plug part and enters into the openings of the power terminals; wherein the anti-mistake bump is engaged with the anti-mistake recess, and these locks are engaged with the hooks of the power terminals.

7. The hybrid plug connector as claimed in claim 1, wherein the hybrid plug connector further comprises two guiding posts, which are symmetrically disposed on the top of the plug housing, and each of which has a column body with a cross-shaped section and a tip end.

8. The hybrid plug connector as claimed in claim 1, wherein the signal plug part further includes a row of retaining holes formed on the top thereof and communicated with the corresponding signal terminal-receiving passages; the insulative frame has a cut formed on the top thereof and a cantilever beam located in the cut and extending backward from a front wall of the cut; the cantilever beam forms a protrusion protruding upward on the end thereof; the cut of the insulative frame is aligned with the corresponding retaining hole of the signal plug part, and the cantilever beam and the protrusion enter into the corresponding retaining hole.

9. The hybrid plug connector as claimed in claim 1, wherein the plug housing has two power plug parts located two sides of the signal plug part respectively; a front surface of the signal plug part is located in front of a front surface of each power plug part; and the row of signal terminal assemblies is located in the middle of the row of power terminals.

10. The hybrid plug connector as claimed in claim 1, wherein the plug housing is further provided with multiple narrow holes on the top thereof; and these narrow holes are communicated with some power terminal-receiving passages for dissipating the heat.

* * * * *